United States Patent [19]

Stoltman

[11] 4,318,869

[45] Mar. 9, 1982

[54] CARBURETOR

[75] Inventor: Donald D. Stoltman, Henrietta, N.Y.

[73] Assignee: General Motors Corporation, Detroit, Mich.

[21] Appl. No.: 234,701

[22] Filed: Feb. 17, 1981

[51] Int. Cl.[3] ..... F02M 7/18

[52] U.S. Cl. ..... 261/50 R; 123/440; 137/595; 251/129; 251/285; 261/121 B; 261/DIG. 74

[58] Field of Search ..... 261/50 R, 121 B, DIG. 74; 123/440; 251/129, 285; 137/595

[56] References Cited

U.S. PATENT DOCUMENTS

| | | | |
|---|---|---|---|
| 2,828,937 | 4/1958 | Kreitchman | 251/129 |
| 3,469,590 | 9/1969 | Barker | 251/129 |
| 3,855,974 | 12/1974 | Mayer . | |
| 4,127,314 | 8/1980 | Dysarz | 261/50 R |
| 4,136,645 | 1/1979 | Ito et al. . | |
| 4,178,332 | 12/1979 | Hogeman et al. . | |
| 4,218,669 | 8/1980 | Hitchcock et al. | 251/129 |
| 4,223,651 | 9/1980 | Eshelman et al. | 123/440 |
| 4,279,841 | 7/1981 | Stettner | 261/50 R |

*Primary Examiner*—Tim R. Miles
*Attorney, Agent, or Firm*—C. K. Veenstra

[57] ABSTRACT

In a carburetor, a linear motor assembly urges the metering apparatus against a biasing spring with a force related to the linear motor current, and an adjusting screw grounds a portion of the active turns of the biasing spring to vary its spring rate and thereby establish the position of the metering apparatus and thus the carburetor fuel flow for a selected linear motor current.

3 Claims, 1 Drawing Figure

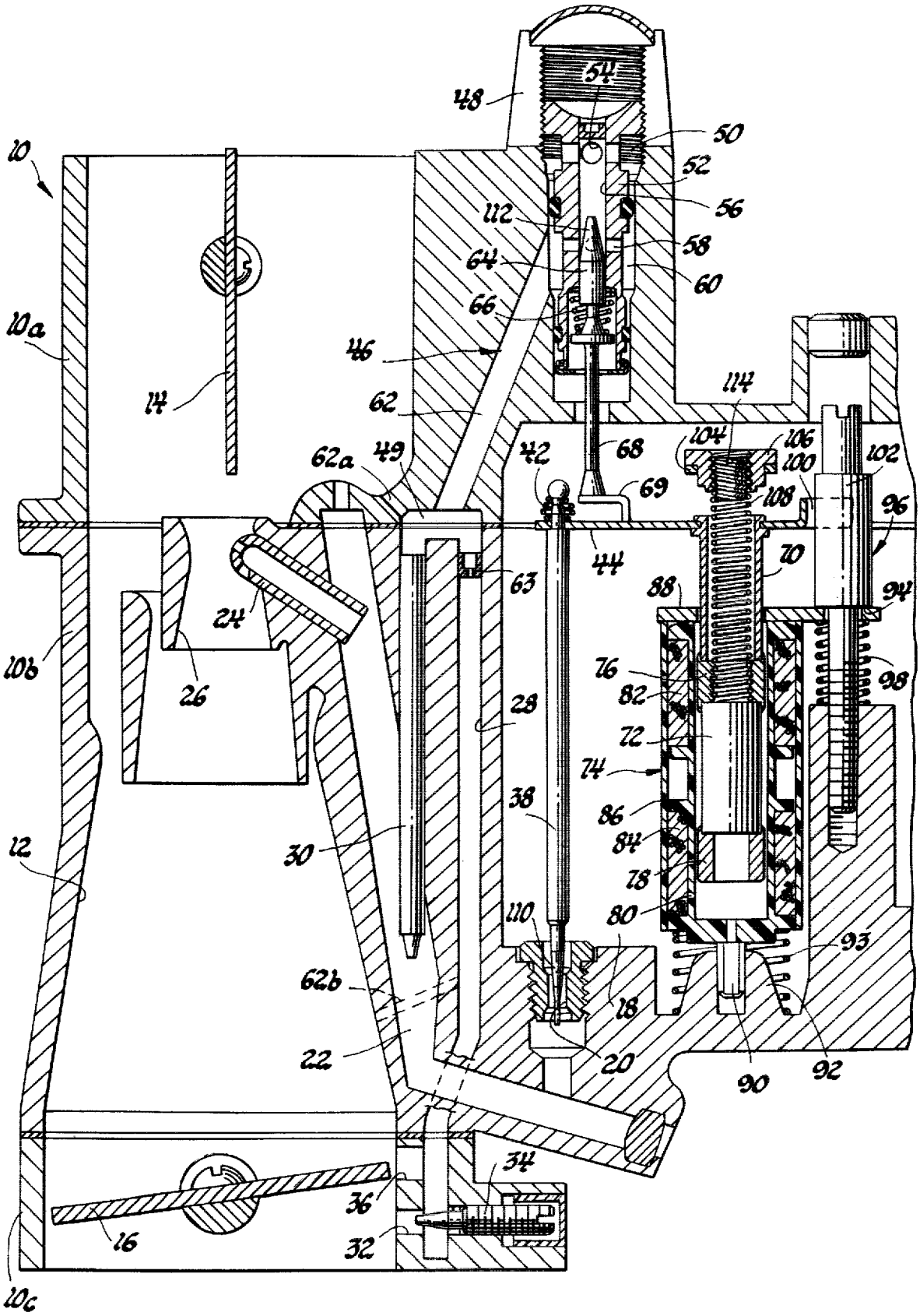
10
10a
10b
10c
12
14
16
18
20
22
24
26
28
30
32
34
36
38
42
44
46
48
49
50
52
54
56
58
60
62
62a
62b
63
64
66
68
69
70
72
74
76
78
80
82
84
86
88
90
92
93
94
96
98
100
102
104
106
108
110
112
114

CARBURETOR

TECHNICAL FIELD

This invention relates to a carburetor particularly suitable for operation in a closed loop fuel system.

BACKGROUND

Several carburetors have been proposed for the purpose of creating an air-fuel mixture of substantially constant (usually stoichiometric) air-fuel ratio for an internal combustion engine. In general, it has been contemplated that such a carburetor would be used in a closed loop system having a sensor which, for example, measures the oxygen content of the engine exhaust gases as an indication of the air-fuel ratio of the mixture created for the engine and which initiates a feed-back signal causing the carburetor to create a mixture of the desired air-fuel ratio.

Certain carburetors adapted for that application have an electronically controlled device which drives a fuel metering apparatus between rich and lean positions according to a pulse width modulated duty cycle; the metering apparatus is maintained in the lean position for a portion of the duty cycle and in the rich position for the remainder of the duty cycle. The carburetor thus duty cycle modulates the fuel flow between a maximum and a minimum and then averages the maximum and minimum fuel flows to create a mixture of the desired air-fuel ratio.

SUMMARY OF THE INVENTION

This invention provides a carburetor also suited for use in a closed loop fuel system. In this carburetor, however, the metering apparatus is positioned by a linear motor.

One advantage of such a carburetor arises from its potential for avoiding fluctuations in air-fuel ratio due to duty cycle modulation of the fuel flow between a maximum and a minimum. Accordingly, this carburetor has potential for enhancing operation of low emission engine systems which are most effective when the air-fuel mixture is maintained within a very narrow band around the stoichiometric air-fuel ratio.

Another advantage of such a carburetor arises from the opportunity to bias the metering apparatus to an intermediate position and allow the linear motor to move the metering apparatus in the rich direction or the lean direction as may be required. With such a construction, the carburetor may be calibrated to provide a mixture of any desired air-fuel ratio without exercising electronic control, and the linear motor with its associated electronic control may be employed to move the metering apparatus only as changes in air-fuel ratio are required.

A particular feature of this invention is the structure for calibrating the carburetor. In this carburetor, a helically wound coil spring biases the metering apparatus to some established position, and the linear motor urges the metering apparatus away from the established position with a force related to the current energizing the motor. It is desirable that the position of the metering apparatus and thus the carburetor fuel flow and air-fuel ratio change a precise amount for a particular change in the current energizing the motor. This invention provides means for varying the number of active turns in the biasing spring to thereby vary the bias which the spring exerts on the metering apparatus. Thus when the motor is energized with a particular current, the opposing spring bias may be adjusted to establish the corresponding position of the metering apparatus and the corresponding fuel flow and air-fuel ratio. This invention accordingly provides means for establishing the gain or the change in fuel flow and air fuel-ratio with a change in the linear motor current.

The details as well as other features and advantages of this invention are set forth in the following description of a preferred embodiment and are shown in the accompanying drawing.

SUMMARY OF THE DRAWING

The sole FIGURE of the drawing is a schematic view of the main and idle metering systems of a carburetor employing this invention.

BEST MODE FOR CARRYING OUT THE INVENTION

Referring to the drawing, an internal combustion engine carburetor 10 has an air horn section 10*a*, a fuel bowl section 10*b* and a throttle body section 10*c* which define an air induction passage 12 controlled by a choke 14 and a throttle 16. Within fuel bowl section 10*b*, a fuel bowl 18 delivers fuel through a main metering orifice 20 into a main fuel passage 22 which discharges through a nozzle 24 into a venturi cluster 26 disposed in induction passage 12.

An idle fuel passage 28 has a pick-up tube 30 extending into main fuel passage 22, an idle discharge port 32 opening into induction passage 12 past a threaded adjustable mixture needle 34, and an off-idle port 36 opening into induction passage 12 adjacent throttle 16.

A tapered main metering rod 38 disposed in orifice 20 is biased by a spring 42 to follow a horizontally disposed bracket 44.

In air horn section 10*a*, an idle air bleed passage 46 extends from an inlet slot 48 to the upper portion 49 or idle fuel passage 28; passage 46 includes an annulus 50 about an air bleed body 52, upper ports 54 through body 52, an axial bore 56 in body 52, lower ports 58 through body 52, a second annulus 60 about 52, and a lower section 62 opening into idle fuel passage 28. A side idle air bleed 62*a* also opens into idle fuel passage 28 upstream of an idle channel restrictor 63, and a lower idle air bleed 62*b* opens into idle fuel passage 28 downstream of restrictor 63.

A tapered idle bleed valve 64 is disposed in bore 56 to traverse the air bleed metering area defined by the opening of lower ports 58 from bore 56. Bleed valve 64 is biased by a spring 66 so that its tail 68 floats on a tab 69 extending upwardly from bracket 44.

Bracket 44 is secured to a sleeve 70 carried by the permanent magnet armature 72 of a linear motor assembly 74. Armature 72 has upper and lower tips 76 and 78 which guide armature 72 in a spool 80. Spool 80 has a pair of windings 82 and 84 and is surrounded by a casing 86 which secures spool 80 to an end plate 88. At the lower end, spool 80 has a pin 90 which is guided in a boss 92 to locate motor assembly 74 within fuel bowl 18.

A spring 93 biases motor assembly 74 upwardly so that end plate 88 engages the shoulder 94 of a threaded adjustable stop 96. A spring 98 surrounds stop 96 to inhibit changes in the setting of stop 96 due to vibration.

Bracket 44 is bifurcated at 100 to surround an extended shank 102 on stop 96. Shank 102 thus prevents rotation of armature 72 and bracket 44.

A bridge 104 extends upwardly from end plate 88 to support a nut 106 above armature 72. Both the interior of nut 106 and the interior of armature tip 76 are threaded to receive a helically wound coil spring 108. Spring 108 thus suspends armature 72 between windings 82 and 84.

In operation, the current through windings 82 and 84 will create a force to drive the metering apparatus (metering rod 38, bracket 44, bleed valve 64 and armature 72) either upwardly against the bias in compression of spring 108 or downwardly against the bias in tension of spring 108. As the metering apparatus is driven upwardly (in the rich direction), the tapered tip 110 of metering rod 38 permits increased fuel flow from fuel bowl 18 through metering orifice 20, main fuel passage 22 and nozzle 24 to induction passage 12, while the tapered tip 112 of bleed valve 64 inhibits air flow through ports 58 and thus permits increased fuel flow through idle fuel passage 28 to induction passage 12. As the metering apparatus is driven downwardly (in the lean direction), the tip 110 of metering rod 38 restricts fuel flow from fuel bowl 18 through metering orifice 20, main fuel passage 22 and nozzle 24 to induction passage 12, while the tip 112 of bleed valve 64 allows increased air flow through ports 58 into idle fuel passage 28 and thus restricts fuel flow through idle fuel passage 28 to induction passage 12.

It is contemplated that windings 82 and 84 will be energized according to a high frequency duty cycle having a pulse width determined by a sensor measuring the air-fuel ratio of the mixture created by carburetor 10—such as a sensor measuring the oxygen content of the engine exhaust gases—and accordingly the effective currents through windings 82 and 84 will drive the metering apparatus upwardly (in the rich direction) when additional fuel flow is required to enrich the mixture to the desired air-fuel ratio and downwardly (in the lean direction) when a reduction in fuel flow is required to lean the mixture to the desired air-fuel ratio.

Such a carburetor is most efficient if the position of the metering apparatus, and thus the fuel flow, changes a precise amount for a particular change in the currents through windings 82 and 84. Accordingly, nut 106 is initially adjusted to properly position armature 72 between windings 82 and 84, and stop 96 is initially adjusted to move linear motor assembly 74 so that metering rod 38 is positioned to provide the proper fuel flow through orifice 20. Then linear motor assembly 74 is energized with a selected current or currents through one or both of windings 82 and 84 to drive the metering apparatus either upwardly or downwardly, and an adjusting screw 114 is positioned in one end of spring 108 (here shown as the upper end) to cause the metering apparatus to move to the position providing the carburetor fuel flow desired for that selected current.

Adjusting screw 114 engages a variable portion of the active turns in spring 108 and thereby varies the number of active turns remaining in spring 108; accordingly, screw 114 adjusts the rate at which the bias of spring 108 increases in compression and tension. Thus when linear motor assembly 74 is energized with a selected current and adjusting screw 114 is turned, the metering apparatus is moved to that position in which the electromagnetic force urging armature 72 in one direction is balanced by the opposing spring bias on armature 72.

With this invention, therefore, the position of the metering apparatus and thus the carburetor fuel flow will respond in a predictable manner to changes in the combination of currents through windings 82 and 84.

It will be appreciated that this invention may be embodied in a single stage two barrel carburetor by addition of another induction passage 12, main fuel passage 22, orifice 20, metering rod 38, idle fuel passage 28, mixture needle 34, and air bleed section 62; duplication of bracket 44, linear motor assembly 74, air bleed body 52 and valve 64, and stop 96 is not required. Moreover, this invention may be embodied in a multiple stage carburetor by addition of one or more secondary stage induction passages and associated systems of conventional construction.

The embodiments of the invention in which an exclusive property or privilege is claimed are defined as follows:

1. A carburetor comprising a fuel passage, a metering apparatus reciprocable in rich and lean directions, said metering apparatus including a metering element adapted to effect an increase in fuel flow through said passage as said metering apparatus moves in said rich direction and a decrease in such fuel flow as said metering apparatus moves in said lean direction, a helically wound coil spring having a number of active turns biasing said metering apparatus in one of said directions with a force related to the position of said metering apparatus and to the number of such turns, said metering apparatus further including a linear motor armature connected to said metering element, a linear motor winding energizable for urging said metering apparatus in the other of said directions with a force related to the current through said winding, whereby the position of said metering apparatus and thus the fuel flow through said passage varies with such current, said calibration means for varying said number of active turns in said coil spring to thereby establish the position of said metering apparatus and thus the fuel flow through said passage for a selected current through said winding.

2. A carburetor comprising a fuel passage, a metering apparatus reciprocable in rich and lean directions, said metering apparatus including a metering element adapted to effect an increase in fuel flow through said passage as said metering apparatus moves in said rich direction and a decrease in fuel flow through said passage as said metering apparatus moves in said lean direction, a helically wound coil spring having a number of active turns for biasing said metering apparatus to an established position with a force related to the position of said metering apparatus and to the number of such turns, said metering apparatus further including a linear motor armature connected to said metering element, a pair of linear motor windings energizable for urging said metering apparatus from said established position with a force related to the currents through said windings, whereby the position of said metering apparatus and thus the fuel flow through said passage varies with such currents, and calibration means for varying said number of active turns in said coil spring to thereby establish the position of said metering apparatus and thus the fuel flow through said passage for a selected combination of currents through said windings.

3. A carburetor comprising main and idle fuel passages, an air bleed opening into said idle fuel passage, a metering apparatus reciprocable in rich and lean directions, said metering apparatus including a bracket and a metering rod operated by said bracket to permit increased fuel flow through said main fuel passage as said metering apparatus moves in said rich direction and to decrease fuel flow through said main fuel passage as said metering apparatus moves in said lean direction, said metering apparatus also including an idle bleed valve operated by said bracket to decrease air flow through said air bleed and thus effect an increase in fuel flow through said idle fuel passage as said metering apparatus moves in said rich direction and to permit increased air flow through said air bleed and thus effect a decrease in fuel flow through said idle fuel passage as said metering apparatus moves in said lean direction, a bridge, a helically wound coil spring having an end secured to said bridge and an end secured to said metering apparatus and having a number of active turns biasing said metering apparatus toward an established position with a force related to the position of said metering apparatus and to the number of such turns, said metering apparatus further including a linear motor armature connected to said bracket, a pair of linear motor windings energizable for urging said metering apparatus from said established position with a force related to the currents through said windings, whereby the position of said metering apparatus and thus the fuel flow through said passages varies with such currents, and a calibration screw engaging one end of said coil spring to vary said number of active turns and thereby establish the position of said metering apparatus and thus the fuel flow through said passages for a selected combination of currents through said windings.

* * * * *